United States Patent [19]

Ayer

[11] Patent Number: 4,477,137

[45] Date of Patent: Oct. 16, 1984

[54] ZERO INSERTION FORCE CONNECTOR FOR FLAT CABLE

[75] Inventor: George E. Ayer, Naperville, Ill.

[73] Assignee: Allied Corporation, Morris Township, Morris County, N.J.

[21] Appl. No.: 410,678

[22] Filed: Aug. 23, 1982

[51] Int. Cl.[3] ..... H01R 9/07

[52] U.S. Cl. ..... 339/59 M; 339/17F; 339/176 MF

[58] Field of Search ..... 339/17 F, 176 MF

[56] References Cited

U.S. PATENT DOCUMENTS

| | | | |
|---|---|---|---|
| 3,088,090 | 4/1963 | Cole et al. | 339/17 F |
| 3,149,896 | 9/1964 | Hall | 339/17 F |
| 3,477,059 | 11/1969 | Cole | 339/17 F |
| 3,851,294 | 11/1974 | Palazzetti et al. | 339/176 MF |
| 3,999,826 | 12/1976 | Yurtin | 339/176 MF |

FOREIGN PATENT DOCUMENTS

| | | | |
|---|---|---|---|
| 2844346 | 4/1979 | Fed. Rep. of Germany | 339/17 F |

*Primary Examiner*—John McQuade
*Attorney, Agent, or Firm*—James P. DeClercq

[57] ABSTRACT

A connector for a flat multiconductor flexible cable having a support surface for the cable having a nonplanar portion, and a clamping member having a clamping surface nonplanar in part which is complementary to the support surface for restraining longitudinal motion of the cable relative to the connector by forcing the cable into conformity with the contour of the support and clamping surfaces, and for stiffening the cable adjacent an array of electrical contacts to provide the cable with a rigid contact surface irrespective of localized contact between the clamping member and the flat cable. The clamping member is integrally hinged to a base member including the supporting surface, the hinge being interrupted to form an entrance aperture for the cable and guide surfaces for the cable, and a keying means cooperating with a notch in the end of the cable for insuring correct insertion of the cable.

2 Claims, 3 Drawing Figures

ZERO INSERTION FORCE CONNECTOR FOR FLAT CABLE

The instant application relates to an electrical connector. In particular, this application relates to an electrical connector for establishing electrical connection between a circuit element in the form of a flat cable and a second circuit element.

Flat cables and flexible circuits are wellknown in the art, and are popular and widely used due to their ability to be used in limited spaces, to allow movement between circuit elements for servicing and repair, for being unobtrusively laid under rugs and carpeting, and for assemblies such as keyboards where the interconnecting flat cable and the individual keyboard contact areas are an integral assembly.

Various connectors for establishing connection to flat cable have been proposed. Some connectors believed to be suitable for establishing connection with flat cable are shown in U.S. Pat. No. 3,989,336, issued to Rizzio, Jr. et al on Nov. 2, 1976, U.S. Pat. No. 4,235,500, issued to Belopavlovich et al on Nov. 25, 1980, and U.S. Pat. No. 4,334,728 issued to Reynolds et al on June 15, 1982.

The patent to Rizzio, Jr. et al shows a plurality of open loop members, into which the end of a flat cable is inserted, and a cover member which serves to press the loop members against conductors of the flat cable. Strain relief of the cable is accomplished by threading the cable through two slots to bend it back upon itself. The slots are provided in a movable cover, so that a pulling force applied to the flat cable may disengage the cover and open the connector. This method of strain relief also requires delicate threading around sharp corners, which may break the thin conductors of flat cable. Since there is no visual indication that the cable is fully seated within the connector, this threading operation may dislodge the cable with no indication that the cable is not properly in place.

The patent to Belopavlovich discloses a connector with a plurality of domed contact members protruding from retaining grooves, against which flat cable is placed, and a separate metallic cover which is snapped or slid into place to urge the flat cable against the domed contacts. The connector includes ramped protrusions, for cooperating with punched holes in the flat cable to retain it in the connector. Thus, the cable must be prepared with special tools, so that field repair of an item including such a connector is impractical, and, due to the localized strain relief means, a pull upon the cable may cause it to tear at the strain relief openings. Also, it is believed that the use of a metallic cover member may lead to leakage between conductors of the flat cable, since a common metallic element is available to form a bridging member should atmospheric contaminants or damage to the flat cable allow leakage paths from more than one individiual conductor to the cover member.

The patent to Reynolds et al shows a plurality of clips which bear against conductors of a printed circuit board, which may be temporarily lifted with the aid of a special tool, to allow a flat cable to be inserted between the clip and the printed circuit board conductors. The tool is then operated to release the clips, to urge the conductors of the flat cable against the conductors of the printed circuit board. For strain relief, the flat cable is provided with openings which engage legs of the lifting tool to provide positioning and strain relief. This connector also requires special preparation of the cable end, requiring tools that are not conveniently available, making it unsuitable for field repair and the like.

The instant invention provides an electrical connector which avoids these and other problems and disadvantages of prior art connectors.

SUMMARY OF THE INVENTION

The instant invention provides a zero insertion force connector for flat cable, adapted to receive flexible flat cable having connectors deposited or etched on one surface thereof, or having conductors laminated between layers of flexible material and having one of said layers removed adjacent an end by abrasion or other means, or having conductors embedded in an insulating layer.

Thus, it is a primary objective of the invention to provide a connector for a flat multiconductor flexible cable defining a support surface which is nonplanar at least in part for supporting a longitudinal section of the cable, having positioning means for laterally positioning the lateral edge of the cable and an array of electrical contacts exposed at the support surface in spaced-apart relationship corresponding to the spacing of conductors of the flexible cable, and a clamping member having a clamping surface which is complementary to the nonplanar contour of the support surface to both restrain longitudinal motion of the cable relative to the connector and to affect an electrical interconnection between each of said contacts and a corresponding conductor of the flat cable.

It is a primary advantage of the invention that the nonplanar support surface and the complementary clamping surface both act as a strain relief and stiffen the flat cable in a lateral direction by bending it, thus reducing the precision with which the support surface and the clamping surface must be formed, since the bent section of the cable defines a precise contact surface.

It is a further feature of the invention that only a single notch need be made in the end of a flat multiconductor flexible cable to utilize the connector according to the preferred embodiment of the invention. Such a notch may be made with simple and commonly available hand tools.

Thus, it is a further advantage of the invention that a connection between a flat multiconductor flexible cable and a connector according to the invention is field-repairable without special tools.

Other objects, features and advantages of the invention will become apparent from the description of the preferred embodiment which follows.

DESCRIPTION OF THE PREFERRED EMBODIMENT

Figure 1:
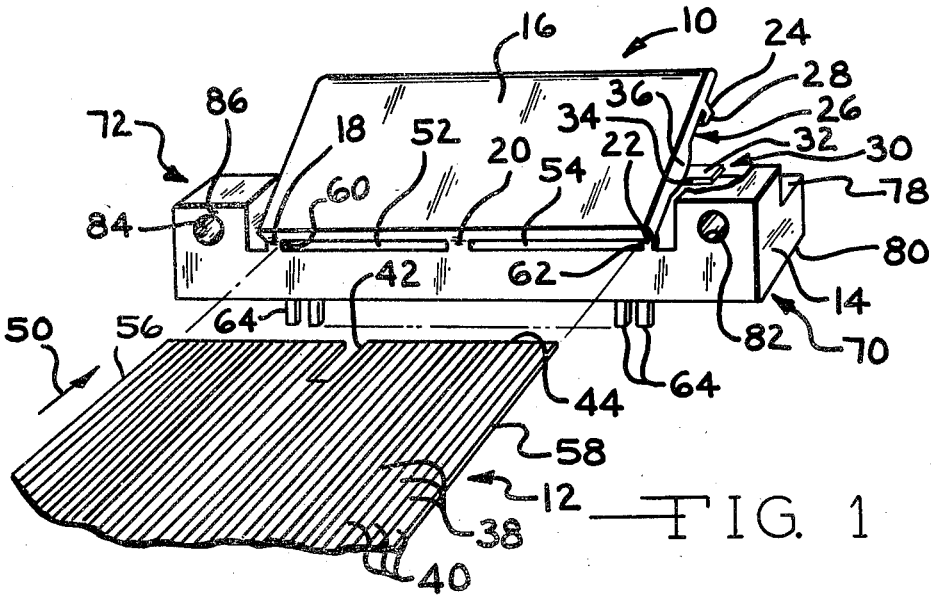
FIG. 1 is a perspective view of the preferred embodiment of the invention, shown with its clamping surface disengaged from the support surface, and with a flat multiconductor flexible cable disengaged from the connector.
Figure 2:
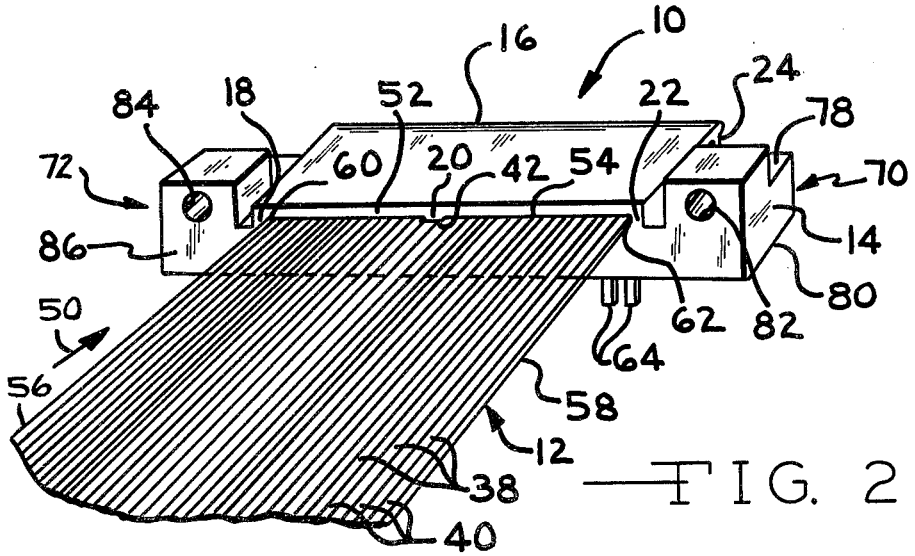
FIG. 2 is a perspective view of the connector of FIG. 1, having the clamping surface engaging the support surface, having a flat multiconductor ductor flexible cable engaging the connector.

FIGS. 1 and 2 show a connector 10 and a section of flat multiconductor flexible cable 12, in an unconnected configuration, and in a connected configuration, respectively.

Figure 3:
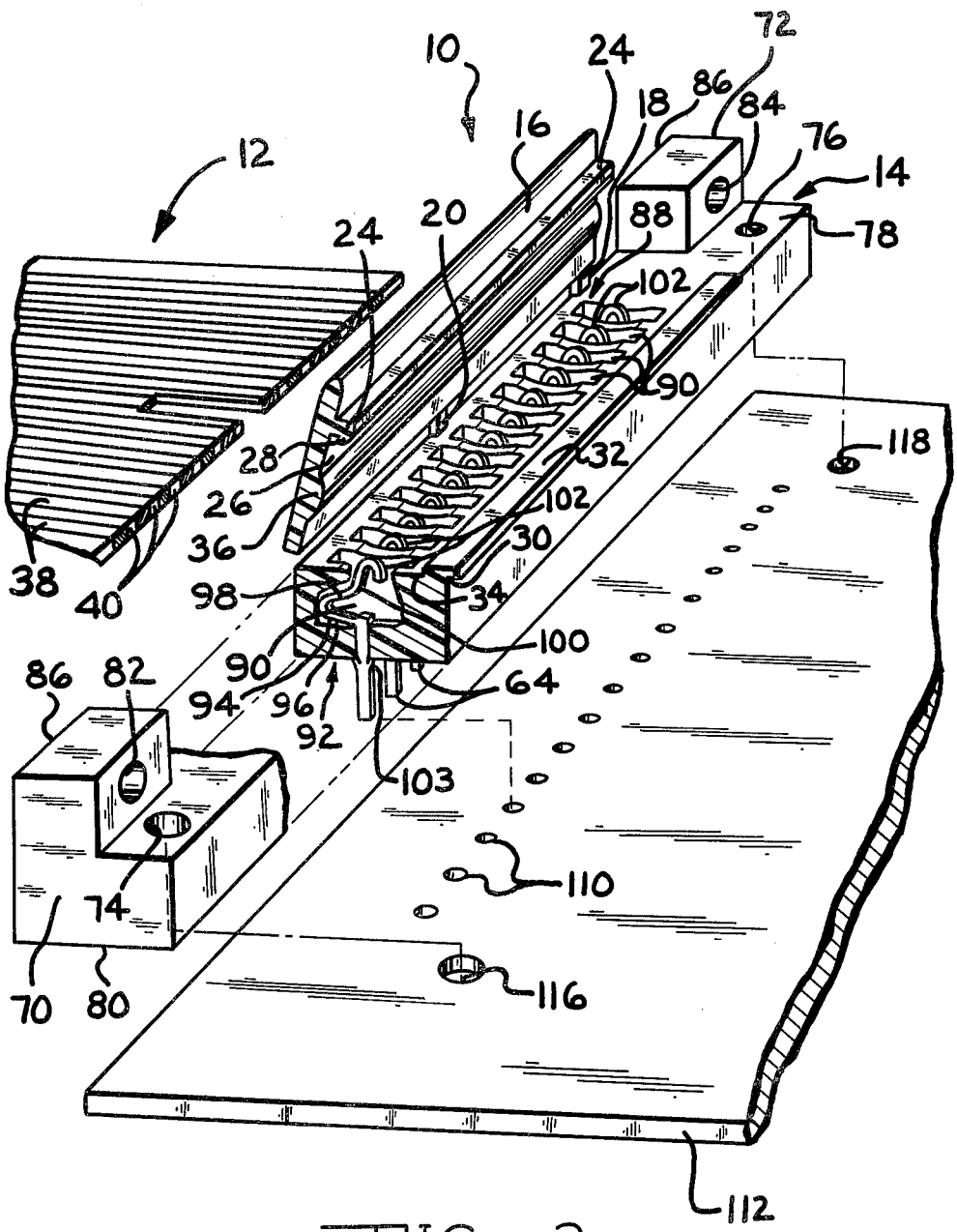
FIG. 3 is a perspective view of the connector shown in FIGS. 1 and 2, disposed adjacent a support surface.

As shown, connector 10 includes a first or base portion 14 and a second portion shown as clamping member 16 in the form of an integrally-hinged cover, integrally formed of a dielectric material with base portion 14 and connected to it by hinge areas 18, 20 and 22. As will appear more fully below, areas 18 and 22 may further serve as cable lateral edge guide members, and area 20 may serve as a key or cable notch guide member. Clamping member 16 includes a latching member 24 projecting from clamping surface 26 of clamping member 16, including a perpendicular projection 28 for engaging a latching surface 30 of lip or ledge member 32, integral with base portion 14, for holding base portion 14 and clamping member in a clamping relationship. Also, as will become more apparent, lip or ledge member 32 includes a positioning surface 34 for controlling the depth of insertion of cable 12 into connector 10. As will be apparent, positioning surface 34 may be omitted if such a connector is to be used at an intermediate portion of a flat multiconductor flexible cable, rather than at an end thereof, as shown. Such an application would involve modification of the preferred embodiment of the invention, such as elimination of hinge area 20, and modification of latching member 24 to extend less than the full width of clamping member 16. As shown in FIGS. 1, 2 and 3, latching member 24 extends transverse to the longitudinal axis of cable 12, and engages a correspondingly-extending latching surface 30. Lip member 32, defining latching surface 30 would be eliminated for use of such a connector at an intermediate location on a flat multiconductor flexible cable, and latching surface 30 would be preferably replaced with one or more indentations to cooperate with perpendicular projection 28, of latching member 24, as modified.

Clamping surface 26 of clamping member 16 includes in part a nonplanar contour shown as a projection 36, which extends the width of clamping member 16 in the direction of a straight line transverse to the longitudinal axis of the flat cable 12 when inserted in connector 10. As will become apparent, nonplanar contour 36 serves to retain cable 12 in position, and also, by bending cable 12 transverse to its longitudinal axis, stiffens and straightens that portion of cable 12, thus relaxing the manufacturing tolerances required for producing a connector according to the invention, since the cable 12 itself then defines a rigid surface without the need for continuous support along that surface.

As can be seen in FIGS. 1 and 2, flat multiconductor flexible cable 12 includes a plurality of individual conductors 38 spaced across the width of cable 12, separated and insulated from each other by insulating portions 40. As is wellknown, a cable such as cable 12 may have conductors such as 38 disposed upon one surface of an insulating portion 40, laminated between layers of an insulating portion, or embedded in a supporting flexible matrix of insulating material. Cable 12 is preferably made by printing a thin, visually-transparent flexible surface with a conductive ink, in a conductor pattern, and covering the conductor pattern with an easily-abradable protective layer. If laminated, it will be apparent that conductors 38 must be exposed, such as by abrasion, as is conventional for exposing conductors of various types of flat cable. Some suitable abrading devices include a resilient abrading wheel, to accommodate both round and flat conductors of flat multiconductor flexible cable. The preferred embodiment of the instant invention is best suited for use with flat conductors, although also usable with round conductors, if desired. Cable 12 is shown as prepared for use with the illustrated preferred embodiment of the invention by the formation of a notch 42 adjacent end surface 44 of cable 12, adapted to accept hinge area 20, to allow insertion of cable 12 into connector 10. Notch 42 may be made with simple and conveniently available tools, such as a small knife, for field repair, if necessary, and may be formed at any convenient point on end surface 44, to accommodate a hinge area 20 which may also be placed at any convenient point between hinge areas 18 and 22, to form a key, to prevent installation of cable 12 in an incorrect position, or to prevent the installation of an incorrect one of several cables such as cable 12 into a particular connector 10.

To utilize connector 10, cable 12, with notch 42, is moved in the direction of arrow 50, lying parallel to the longitudinal axis of cable 12 towards connector 10, and inserted through openings 52 and 54, defined respectively between hinge areas 18 and 20, and between hinge areas 20 and 22, first edge 56 of cable 12 being laterally positioned by positioning means shown as surface 60 of hinge area 18 and surface 62 of hinge area 22. Cable 12 may also be longitudinally positioned by contact of end surface 44 with positioning surface 34. Then, clamping member 16 is manually depressed, until perpendicular projection 28 snaps over lip member 32 and engages latching surface 30, forcing each individual conductor 38 against a contact member, establishing electrical continuity between each individual conductor 38 and one of a plurality of contact terminal portions 64.

As more clearly shown in FIG. 3, base portion 14 includes a first end 70 and a second end 72, ends 70 and 72 being provided with means for mounting connector 10 to a supporting surface such as a printed circuit board, and provisions for mounting connector 10 and said first support surface to a second support surface, if desired. As illustrated, ends 70 and 72 are provided with apertures 74 and 76, respectively, extending between a first or upper surface 78 and a lower or second surface 80. Ends 70 and 72 also define apertures 82 and 84, respectively, extending in the direction of the longitudinal axis of cable 12, and extending perpendic-ular to surface 86, which surface 86 defines hinge areas 18, 20 and 22, and openings 52 and 54. Apertures 82 and 84 may be used to mount connector 10 and the surface to which connector 10 is attached to another surface, so that connector 10 itself may be used as both a novel connector and as a mounting device for the surface to which it is electrically attached.

As best shown in FIG. 3, connector 10 includes a support surface having at least in part a nonplanar contour complementary to that of the nonplanar contour forming projection 36 of clamping surface 26 of clamping member 16. As illustrated, the nonplanar interfitting contour complementary to projection 38 is shown as an interrupted concave indentation 88. Indentation 88 is interrupted by a plurality of cavities 90, each cavity 90 containing a contact member 92 including a contact terminal portion 64, and two generally U-shaped portions disposed at right angles to each other. Each contact member 92 includes a first U-shaped or arcuate portion 94 having a first leg portion 96 joined to terminal portion 64 and a second leg 98 joined to a leg of second portion 100, also in the form of an arcuate section or generally U-shaped portion and having a bight portion serving as a contact portion for establishing electrical connection with corre-sponding individual conductors 38. As will be apparent, first portion 94 of contact member 92 acts as a spring or resilient portion, although, as will be apparent, numerous contact configurations may also be used, due to the stiffening and straightening effect of portions 36 and 88 of the instant invention. As will be apparent, contact portions 102 are oriented along a substantially straight line transverse to the longitudinal axis of the flat cable 12, when it is positioned upon the supporting surface defined by surface 78, a substantially planar surface, and indentation 88. This structure, with portions of indentation 88 of surface 78 forming a concave recessed portion adjacent each contact member 92, and concave on both sides of the straight line defined by the array of contact members 92 and each contact portion or exposed extremity 102 extending above the lowermost extent of interrupted indentation 88 but below the plane of the planar portion of surface 78, which permits cable 12 to pass freely over the support surface prior to clamping by the clamping surface 26 of clamping member 16.

Contact members 92 provide a wiping contact to establish good electrical connection to the individual conductors 38 of cable 12. The arcuate configuration of contact portion 102, and the effective resilient hinge action of first portion 94 allows contact portions 102 to move in a wiping manner in the direction of the longitudinal axis of cable 12 when clamping member 16 is manually actuated.

Contact terminal portions 64 may be molded into connector 10 at the time of its formation, and may be provided with barbs or the like as is conventional to aid in its retention, or they may be inserted after the formation of the dielectric portion of connector 10 and staked in place adjacent surface 80, or may be provided with a protrusion such as tang 103, for engaging surface 80 after contact 92 is seated within its respective cavity 90.

As shown in FIG. 3, each contact terminal portion of each contact member 92 is in the form of a conductive pin adapted to be received by a corresponding termination hole defined by a mounting surface 112, which may be a printed circuit board or the like. As will be apparent, mounting surface 112 may be provided with conductive paths leading to respective termination holes 110, and termination holes 110 may be plated or grommeted to facilitate electrical connection by soldering between conductive paths of a supporting surface 112 and each terminal member 64, to enable an electrical connection to be made to different ones of the conductors 38 of cable 12. Alternatively, contact terminal portions 64 may be used as wire-wrap pins, quick-connect terminals, soldered terminals, or as otherwise desired, since a mounting means such as a bolt passed through aperture 74 and an aperture 116 defined in mounting surface 112, and through aperture 76 and an aperture 118 defined in surface 112 may be used to fasten connector 10 to surface 112, thus relieving terminal portions 64 and termination holes 110 from withstanding the mechanical stress of holding connector 10 to surface 112.

Thus, the instant invention provides a novel connector for flat cable having novel and advantageous strain relief means combined with straightening and stiffening means, and a keying means which may be accomplished with simple hand tools, facilitating field repair.

Many other configurations of connectors for flat cable incorporating the spirit of the instant invention will be apparent to one having skills in the art, and may be easily made without departing from the spirit and scope of the invention.

I claim:

1. A connector for a flat multiconductor cable, comprising:

a first portion, said first portion defining a support surface for supporting a predetermined longitudinal portion of said cable;

said support surface having a first planar portion and a second contoured portion, said second contoured portion extending in the lateral direction of said cable when said cable is supported on said support surface;

positioning means for positioning said cable upon said support surface when said cable is supported on said support surface, said positioning means engaging first and second lateral edges of said cable, said cable having first and second lateral edges;

an array of electrical contact members retained in said first portion and protruding from said support surface in spaced-apart, electrically-insulated relationship to one another, each said electrical contact member being disposed to be aligned with a predetermined different conductor of said flat multiconductor flexible cable when said positioning means are engaging said first and second lateral edges of said cable;

a clamping member for urging said cable against said array of contacts;

said clamping member defining a clamping surface, said clamping surface defining a third contoured portion complimentary in configuration to said second contoured portion;

said connector including holding means for retaining said clamping member with said clamping surface in fixed pressured interfitting complimentary relationship with said support surface after said cable has been positioned on said support surface to restrain motion of said cable in the longitudinal direction of said cable with respect to said connector by forcing said cable into substantial conformity with said second contoured portion and said third contoured portion and to effect an electrical connection between each of said contact members and a correspondingly different conductor of said flat multiconductor flexible cable;

said positioning means further including at least one cable notch guide member extending from said support surface intermediate said first and second lateral edges of said cable when said cable is supported on said support surface for engaging a longitudinally-extending notch defined in a laterally-extending and surface of said cable;

said positioning means including said notch guide means and being defined by a plurality of openings defined in a hinge means, said holding means including said hinge means.

2. A connector for a flat multiconductor flexible cable, comprising:

a body portion, a cover portion hinged to said body portion by a hinge portion, latching means disposed opposite said hinge portion for latching a free edge of said cover portion to said body portion, and a plurality of electrical contact members retained in said body portion for establishing electrical connection to individual conductors of said cable;

said hinge portion defining at least one opening therethrough for receiving said flat multiconductor cable therethrough to position said cable between said body portion and said cover portion and adjacent said plurality of electrical contact members.

* * * * *